US007520081B2

(12) United States Patent
Kroll

(10) Patent No.: US 7,520,081 B2
(45) Date of Patent: Apr. 21, 2009

(54) ELECTRIC IMMOBILIZATION WEAPON

(75) Inventor: Mark Kroll, Simi Valley, CA (US)

(73) Assignee: TASER International, Inc., Scottsdale, AZ (US)

( * ) Notice: Subject to any disclaimer, the term of this patent is extended or adjusted under 35 U.S.C. 154(b) by 208 days.

(21) Appl. No.: 11/182,051

(22) Filed: Jul. 13, 2005

(65) Prior Publication Data

US 2007/0019358 A1 Jan. 25, 2007

Related U.S. Application Data

(60) Provisional application No. 60/587,142, filed on Jul. 13, 2004, provisional application No. 60/587,141, filed on Jul. 13, 2004, provisional application No. 60/587,140, filed on Jul. 13, 2004.

(51) Int. Cl.
*F41C 9/00* (2006.01)

(52) U.S. Cl. ..... 42/1.08; 102/502; 361/232

(58) Field of Classification Search ..... 102/502; 42/1.08

See application file for complete search history.

(56) References Cited

U.S. PATENT DOCUMENTS

| | | | |
|---|---|---|---|
| 2,622,220 | A | 12/1952 | Hodgson |
| 3,295,528 | A | 1/1967 | Masnki |
| 3,523,538 | A | 8/1970 | Shimku |
| 3,803,463 | A | 4/1974 | Cover |
| 4,014,347 | A | 3/1977 | Halleck |
| 4,167,036 | A | 9/1979 | Kenney |
| 4,237,899 | A | 12/1980 | Hagfors |
| 4,253,132 | A | 2/1981 | Cover |
| 4,294,245 | A | 10/1981 | Bussey |
| 4,396,879 | A | 8/1983 | Weinreich |
| RE31,866 | E | 4/1985 | Lines |
| 4,539,937 | A | 9/1985 | Workman |
| 4,759,368 | A | 7/1988 | Spanton |

(Continued)

OTHER PUBLICATIONS

Thomas, C. K., et al., "Pattern of Pulses That Maximize Force Output From Single Human Thenar Motor Units", *The Journal of Neurophysiology*, vol. 82, No. 6, Dec. 1999, pp. 3188-3199.

(Continued)

*Primary Examiner*—Michael Carone
*Assistant Examiner*—Gabriel J Klein
(74) *Attorney, Agent, or Firm*—William R. Bachand

(57) ABSTRACT

An improved electric weapon immobilizes a target by conducting a current through an electrode and through the target. The weapon includes a circuit that outputs a pulse pattern having a first pulse, a second pulse of opposite polarity compared to the first pulse, and a period of no output between the first pulse and the second pulse. The period is in a range from 50 microseconds to 1000 microseconds. The electric weapon repeats the output of the pattern at a rate of 19 repetitions per second. A method for immobilizing a target is performed by an electric weapon. The method includes delivering a first pulse in a first polarity, operating a switch to reverse the polarity of delivery; and delivery the second pulse in a second polarity. The method may further include awaiting lapse of a period between delivery of the first pulse and delivery of the second pulse wherein the period is in the range of from 50 microseconds to 1000 microseconds.

6 Claims, 6 Drawing Sheets

U.S. PATENT DOCUMENTS

| | | | | |
|---|---|---|---|---|
| 4,821,017 | A | 4/1989 | Tanami | |
| 4,852,454 | A | 8/1989 | Batchelder | |
| 4,872,084 | A | 10/1989 | Dunning | |
| 4,943,885 | A | 7/1990 | Willoughby | |
| 5,067,495 | A | 11/1991 | Brehm | |
| 5,193,048 | A | 3/1993 | Kaufman | |
| 5,215,066 | A | 6/1993 | Narishige | |
| 5,235,990 | A * | 8/1993 | Dempsey | 607/145 |
| 5,304,211 | A | 4/1994 | Israel | |
| 5,317,155 | A | 5/1994 | King | |
| 5,350,415 | A | 9/1994 | Cywinski | |
| 5,457,597 | A | 10/1995 | Rothschild | |
| 5,473,501 | A | 12/1995 | Claypool | |
| 5,625,525 | A | 4/1997 | Coackley | |
| 5,654,867 | A | 8/1997 | Murray | |
| 5,675,103 | A | 10/1997 | Herr | |
| 5,698,815 | A * | 12/1997 | Ragner | 102/502 |
| 5,750,918 | A | 5/1998 | Mangolds | |
| 5,801,617 | A | 9/1998 | Langner | |
| 5,831,199 | A | 11/1998 | McNulty, Jr. et al. | |
| 5,841,622 | A | 11/1998 | McNulty | |
| 5,936,183 | A | 8/1999 | McNulty | |
| 5,962,806 | A | 10/1999 | Coakley et al. | |
| 5,988,036 | A | 11/1999 | Mangolds | |
| 6,256,916 | B1 | 7/2001 | McNulty | |
| 6,493,588 | B1 | 12/2002 | Malaney | |
| 6,575,073 | B2 | 6/2003 | McNulty, Jr. et al. | |
| 6,636,412 | B2 | 10/2003 | Smith | |
| 7,057,872 | B2 | 6/2006 | Smith | |
| 7,075,770 | B1 | 7/2006 | Smith | |
| 7,102,870 | B2 | 9/2006 | Nerheim | |
| 7,158,362 | B2 | 1/2007 | Smith | |
| 7,234,262 | B2 | 6/2007 | Smith | |
| 7,280,873 | B2 * | 10/2007 | Freed et al. | 607/72 |
| 2002/0016617 | A1 * | 2/2002 | Oldham | 607/68 |
| 2004/0156163 | A1 * | 8/2004 | Nerheim | 361/232 |
| 2007/0079538 | A1 * | 4/2007 | Smith et al. | 42/1.08 |
| 2007/0106343 | A1 * | 5/2007 | Monogue et al. | 607/48 |

OTHER PUBLICATIONS

Griffin, Lisa et al., "Stimulation Pattern That Maximizes Force in Paralyzed and Control Whole Thenar Muscles", *The Journal of Neurophysiology*, vol. 87, No. 5, May 2002, pp. 2271-2278.

Murray and Resnick, A Guide To Taser Technology, 1997, pp. 121-128, Whitewater Press.

Mortimer J, Motor Prostheses, Handbook of Physiology, 1981, pp. 155-161, vol. II.

Kenny, John M., "Human Effects Advisory Panel Report of Findings: Sticky Shocker Assessment, PennState, Applied Research Laboratory", Jul. 29, 1999, National Criminal Justice Reference Service. Box 6000, Rockville, MD 20849-6000.

Vasel, Edward, "Sticky Shocker", 1203-98-007/2990, Jayeor, San Diego, CA.

T'Prina Technology, "Stun Guns, An Independent Report", 1994, T'Prina Technology, Gateway Station, Aurosa, CO 80044-1126 U.S. A.

Murray, John, "Taser Technology", pp. 21-232 ISBN 0-9548984-0-3; 1997, Whitewater Press, 2301 Whitewater Creek Road, Whitewater, CO 81527.

Jaycor, "Executive Summary, Exerpt from Jaycor Report", Jaycor, San Diego, CA.

Crago, Patrick E. et al., "Closed-Loop Control of Force During Electrical Stimulation of Muscle", IEEE Transactions on Biomedical Engineering. 1980, pp. 306-312, vol. BME-27 No. 6, IEEE Engineering in Medicine and Biology Society, USA.

Crago, Patrick E. et al., "Modulation of Muscle Force by Recruitment During Intramuscular Stimulation", IEEE Transactions on Biomedical Engineering. 1980, pp. 679-684, vol. BME-27 No. 12, IEEE Engineering in Medicine and Biology Society, USA.

Alon, Gad, "Optimization of Pulse Duration and Pulse Charge During Transculaneous Electrical Nerve Stimulation", The Australian Journal of Physiotherapy. 1983, pp. 195-201, vol. 29 No. 6, Australia.

Reilly, J. Patrick, "Applied Bioelectricity", 1988, pp. 105-147; 240-340, Springer-Verlag, NY.

Robinson. M.N. et al, "Electric Shock Devices and their Effects on the Human Body", 1990, pp. 285-300, vol. 30 No. 4, Medicine Science and the Law.

* cited by examiner

ELECTRIC IMMOBILIZATION WEAPON

CROSS-REFERENCE TO RELATED APPLICATIONS

This application is a non-provisional patent application that claims the benefit of: (a) U.S. Patent Application Ser. No. 60/587,140, filed Jul. 13, 2004, by Kroll, entitled "Improved Trajectory Taser Style Device"; (b) U.S. Patent Application Ser. No. 60/587,142, filed Jul. 13, 2004, by Kroll, entitled "Multiple Voltage Taser Style Device"; and (c) U.S. Patent Application Ser. No. 60/587,141, filed Jul. 13, 2004, by Kroll, entitled "Improved Waveform For Taser Style Device". Each of these U.S. Patent Applications is incorporated herein by reference.

FIELD OF THE INVENTION

This invention relates generally to the field or non-lethal weapons and more specifically to such a weapon having two projectiles for electrically immobilizing a live target for capture.

BACKGROUND

Beginning in the late 1970's, law enforcement agencies began to employ electric weapons as a firearm substitute in certain confrontational situations that could otherwise have justified the use of deadly force, for example against knife wielding assailants at close range. These agencies have also employed electric weapons successfully to avoid injury to peace officers, assailants, and innocent bystanders in situations where the use of conventional firearms would have been either impractical or unjustified.

The electric weapon's characteristic, near instantaneous, incapacitating power has been employed to disable an assailant holding jagged glass to a hostage's throat without any physical injury occurring to the hostage. It has also been used to prevent a raging parent from hurling his infant from a high rise, preventing a suicidal man from leaping from a high rise, and subduing unarmed combatants all without serious physical injury to the peace officer or assailant.

Currently manufactured ballistic weapons that output electrical pulses to immobilize and capture human and other animal assailants (e.g., electric weapons including TASER® electric weapons marketed by TASER International, Inc.) have a lower lethality than conventional firearms. An electric weapon launches a first electrically conductive dart and a second electrically conductive dart. Each of the darts remains connected to the weapon after launch by a first and a second electrically conductive wire, respectively. The launched darts strike a target and each dart couples to the target and remains coupled to the target for a period of time. Such coupling can be achieved by a first and a second barbed metallic (conductive) needle (each being positioned at a front of the first and second darts, respectively) the imbed into the target and remain imbedded in the target. Electrical pulses from a pulse generator on-board the weapon travel through the first wire to the first dart, from the first data through the target, and into the second dart. Next, the electrical pulses return to the weapon via the second wire. Thus, a complete circuit is formed of the pulse generator, the first and second wires, the first and second darts (and their respective first and second barbed metallic needles), and a target, e.g., a human, animal, device, or other such target.

It is the delivery of the electrical pulses through the portion of this circuit that comprises the target that results in the incapacitation of the target, provided the electrical pulses are selected to effect incapacitation. The nature of such pulses as heretofore employed is described, inter alia, in, for example, U.S. Pat. No. 7,102,870 to Nerheim, incorporated herein by reference. Electric weapons are described, inter alia, in, for example, U.S. Pat. Nos. 6,575,073 and 5,841,622 to McNulty and U.S. Pat. No. 6,636,412 to Smith, each incorporated herein by reference. McNulty describes an electrical discharge weapon with improved range and an electrical restraint device that outputs 14 to 17 pulses per second for a 3 to 5 second duration. Nerheim describes electronic disabling devices that output from 9 to 19 pulses per second for a 5 second duration or for a duration as long as the trigger switch is held "on". Smith describes an apparatus for preventing locomotion that outputs 2 to 40, preferably, 5 to 15 pulses per second for a duration of 6 to 7 seconds. These current pulses through target tissue cause contraction of skeletal muscles and make the muscles inoperable, preventing use of the muscles in locomotion by the target.

The TASER International model X26 electric weapon launches two darts at substantially equal velocities of about 150 feet per second from a replaceable cartridge attached to the electric weapon. A relatively high voltage is impressed across the darts to conduct a stimulus current in a circuit through the target that may include one or more air gaps. The high voltage forms an arc across these air gaps for each pulse of the stimulus current. The model X26 electric weapon may be used without a cartridge by pressing terminals against the target. The same stimulus signal is used because one or more arcs through clothing may be required to deliver the current through the target. The stimulus current includes a monophasic pulse repeated at typically 17 or 19 pulses per second for 5 seconds. The pulses constitute a current of 2.1 milliamps, or 111 microcoulombs of charge per pulse at 19 pulses per second. Other known electric weapons provide a stimulus current that includes a monophasic pulse repeated at a rate from 5 to 40 pulses per second. The reciprocal of a pulse repetition rate defines a pulse repetition period that for rates 5, 17, 19 and 40 pulses per second defines periods of 200 milliseconds, 59 milliseconds, 53 milliseconds, and 25 milliseconds respectively.

The present invention advantageously addresses the above and other needs.

BRIEF DESCRIPTION OF THE DRAWINGS

Various aspects, features and advantages of the present invention will be more apparent from the following more particular description thereof, presented in conjunction with the following drawings wherein.

Corresponding reference characters indicate corresponding components throughout the several views of the drawings.

DETAILED DESCRIPTION OF THE PREFERRED EMBODIMENTS

Figure 1:
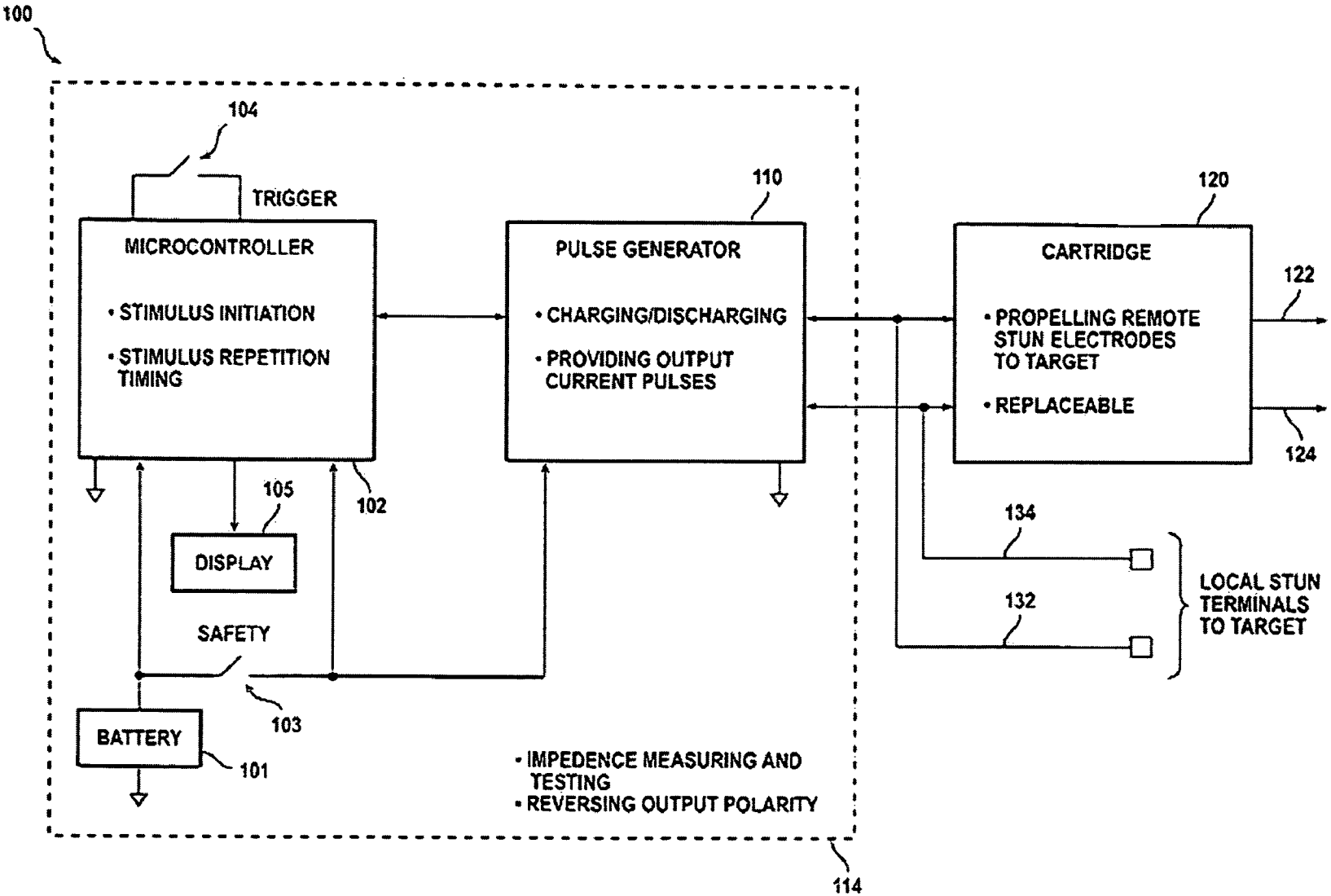
FIG. 1 is a functional block diagram of an electric weapon, according to various aspects of the present invention.

The following description of the presently contemplated best mode of practicing the invention is not to be taken in a limiting sense, but is made merely for the purpose of describing the general principles of the invention. The scope of the invention should be determined with reference to the claims.

An immobilization device may include a housing, a first electrically conductive dart, a second electrically conductive dart, a barrel, an electric circuit (such as an electrical pulse generating circuit) mounted in the housing, a safety mounted on the housing, a trigger mounted on the housing, and a cartridge. The cartridge contains at least the first electrically conductive dart (e.g., a dart comprising a barbed metallic needle, or other electrode) and the second electrically conductive dart (e.g., a dart comprising a barbed metallic needle, or other electrode). The cartridge contains means for firing each dart through the air in the direction toward a target, e.g., a human, animal or device. A powder charge, compressed air, and/or other such known source of ballistic propulsion may be utilized as the means for firing to fire the first dart and the second dart, and are well known in the art. Each of the first and second darts is coupled to the cartridge by a respective first or second electrically conductive wire. The first and second wires are typically sheathed in an insulating material, such as is known in the art, and are typically coiled in the cartridge prior to firing.

The safety is mounted on the housing of the device. The safety controls the activation of the weapon prior to squeezing of the trigger. The trigger is also mounted on the housing near the safety so that an operator can release the safety and squeeze the trigger in a short period of time.

In operation, the cartridge is activated and the first and second darts with their respective ones of the first and second wires are fired (deployed) by the means for firing, for example, expanding gasses acting upon the first and second darts from within the cartridge when an operator manually slides the safety in a selected direction to release the safety and then squeezes the trigger. The trigger serves to actuate the cartridge and thereby initiate the firing of the first and second darts by the means for firing. The first and second wires are carried by the first and second darts, respectively, from the cartridge upon firing. Upon firing, the first and second wires unwind and straighten as each of the first and second darts travels through the air in a direction toward the target.

After firing, a series of pulses is generated by the electric circuit (e.g., an electrical pulse generator) located within the housing. The pulses are carried to the target by the darts and wires. The pulse pass through the target and back to the weapon.

The pulses of electrical potential are selected to have a magnitude, duration, and pulse repetition period that result in an immobilization of the target (preferably, in accordance with some embodiments, without a permanent injury to the target), of preferably sufficient duration (e.g., 5 seconds) to allow the target to be otherwise constrained and to eliminate any threat the target poses to others or to property.

Upon impact of the darts with the target, a distance between the first dart and the second dart at their point of impact with the target defines a spread. A minimum spread for reliably disabling (immobilizing) the target upon application of the pulses discussed above, is presumed to be 7 inches for human targets. The minimum spread causes enough motor neurons to be affected by the pulses to assure immobilization of the target.

Heretofore, a first bore (or first exit bore) within the cartridge is positioned along a horizontal plane of the electric weapon (defined by the barrel), and a second bore (or second exit bore) is positioned vertically below the first bore at an acute angle below the horizontal plane. The first dart is positioned within the first bore prior to firing, and the second dart is positioned within the second bore prior to firing. Upon firing, the darts leave their respective bores and continuously spread an increasing distance from each other as they approach the target.

This method of establishing the dart's divergence from each other has a serious drawback: it greatly limits an electric weapon's range. Both minimum and maximum ranges are limited. For example, the bore axes of heretofore known electric weapons intersect an angle of 12 degrees, with some models with 8 degrees. Using the 12 degree angle for illustrative purposes, for every 5 feet the darts travel toward the target, the darts will spread approximately 1 foot further apart from each other. If the darts contact a target within 2.8 feet along the flight path from the electric weapon, the resulting spread would not likely be effective for disabling the target. The presumed minimum effective spread of 7 inches between the darts would not yet have been achieved. If the darts contact the target at a distance of 15 feet from the electric weapon, the darts are spread approximately 3 feet apart and would not likely both embed in a human or small animal target to complete an electric circuit. Thus, the heretofore known electric weapons' best operational range is from 3 to 12 feet from the electric weapon.

The spread between the darts at close range may be increased by increasing an angle between the first and second bores, i.e., by increasing an angle between the axes of the first and second bores, e.g., by increasing the number of degrees below horizontal of the second bore axis. This, however, causes a corresponding undesired increase in the spread of the darts at longer ranges.

Decreasing the spread between the darts at longer ranges decreases the darts' spread at closer ranges. Thus, long range effectiveness is sacrificed for close range effectiveness and vice versa. The known electric weapons, therefore, have limited tactical application, due to these constraints on operational range.

When the darts strike a human target, an electric current flows between the darts and through the target for a brief period. The current may include short, high voltage pulses having low average current, and low average power. As a result of a physiological effect of the pulses of electric current upon the nerves for the skeletal muscle and/or the nerves for pain, the target experiences a temporary ambulatory incapacitation.

Once the darts have been deployed and the electric circuit is no longer delivering electric pulses through the target, the operator disconnects the cartridge from the barrel. The operator then manually loads into the barrel a new cartridge containing a new pair of darts and coiled wires.

A TASER model X26 performs the functions discussed above. Referring to FIG. 1, an improved electric weapon 100 includes the functional blocks of the TASER model X26, adapted for impendence measuring and testing, and reversing output polarity. Specifically, electric weapon 100 includes circuitry 114, cartridge 120, darts 122 and 124, and terminals 132 and 134. Circuitry 114 includes battery 101, microcontroller 102, safety 103, trigger 104, display 105, and pulse generator 110.

Figure 2:
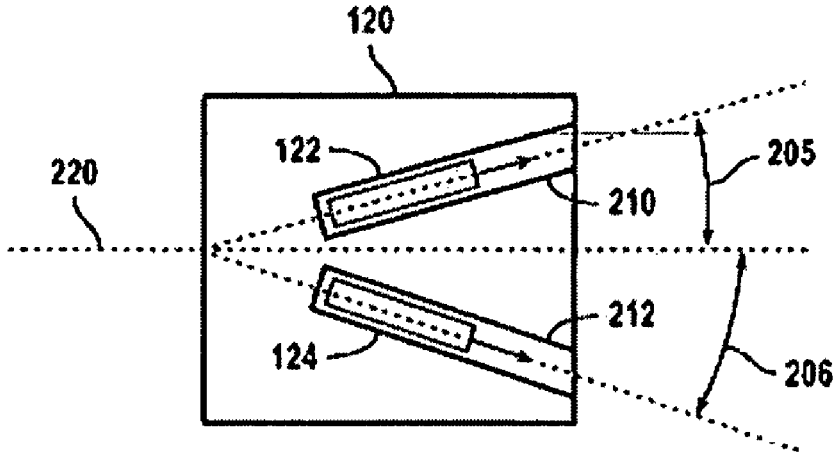
FIG. 2 is a cross section of a cartridge according to various aspects of the present invention.

An immobilization device is improved upon by use of a cartridge 120 as in FIG. 2, wherein the angle 205 of the first bore 210 containing the first dart 122 and the angle 206 of the second bore 212 containing the second dart 124, relative to the horizontal plane 220 as defined by the barrel, are selected as follows. The first dart 122, located above the second dart 124, is angled above the horizontal plane 220. The second dart 124 is angled in a direction below the horizontal plane 220.

In operation, the first dart 122 will follow a parabolic trajectory 300 of FIG. 3 when fired (deployed), first rising above the horizontal plane 220, and then descending below the horizontal plane 220 under the influence of gravitational force (provided sufficient distance from the electric weapon is achieved prior to impact with the target). A lower velocity of the first dart 122 will cause the first dart 122 to descend much sooner. For example, with 100 feet per second velocity, the first dart 122 will cover 20 feet in 0.2 seconds. With gravity, the first dart 122 will fall $16t^2=16*(0.2)^2=0.64$ ft=7.7 inches.

Figure 3:
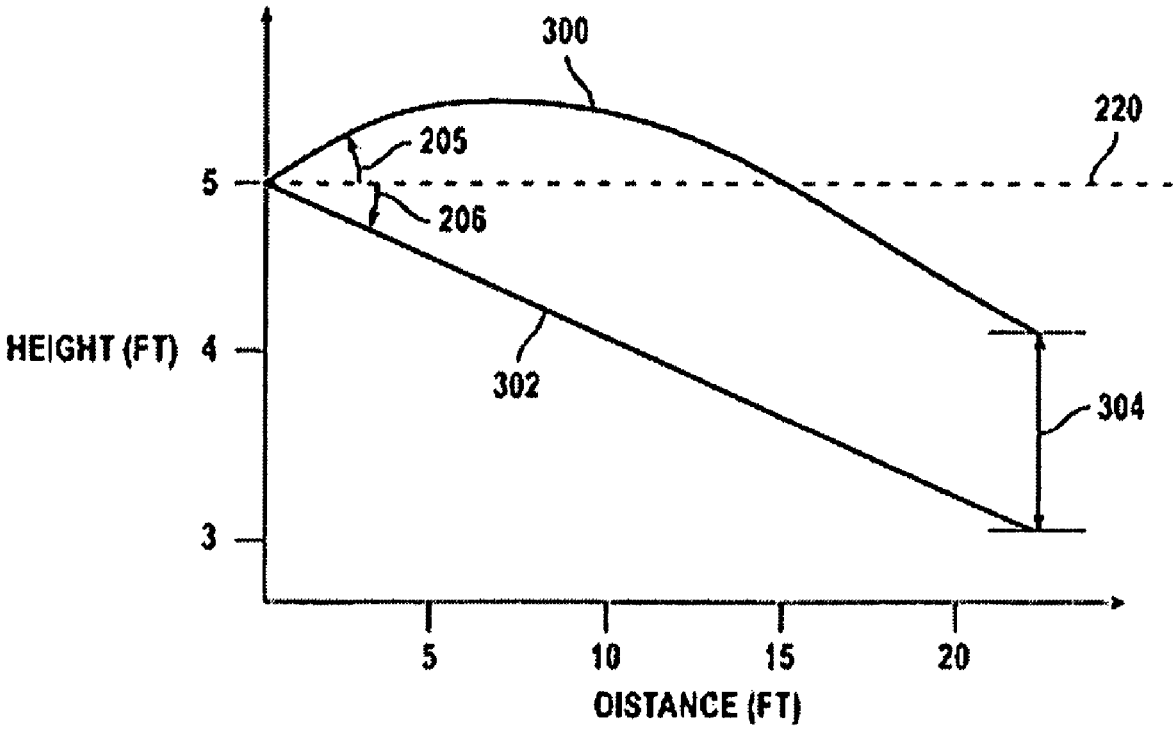
FIG. 3 is a graphical analysis of the trajectories of the darts of the cartridge of FIG. 2.

FIG. 3 graphically illustrates the improved trajectory for the inventive embodiment. Depicted are a first dart trajectory 300 and a second dart trajectory 302. The first dart trajectory 300 corresponds to the path of a first dart 122 as it travels to a target. The second dart trajectory 302 corresponds to the path of a second dart 124 as it travels to the target. The first dart trajectory 300 has an enhanced parabolic shape due to a launch angle 205 of 4 degrees depicted in FIG. 2 (i.e., above horizontal 220, as defined by a barrel) and a reduced velocity. According to various aspects of the present invention, the first dart 122 velocity is reduced in relation to the second dart 124 velocity in order to create an enhanced parabolic trajectory 300. A velocity of the first dart may be 63 feet per second when the velocity of the second dart is 150 feet per second.

A lower initial velocity of the first dart results in a greater effect on the acceleration by vertical gravitational forces acting upon the first dart 122, thereby creating the substantially more pronounced parabolic shape to the trajectory 300 of the first dart 122. The second dart 124 is positioned at a launch angle 206 so to maintain proper spacing with the first dart 122. The first dart's launch angle 205 and second dart's launch angle 206 create a dart separation of 0.6 feet (7.2 inches) at a distance of 4 feet from the weapon. The dart spacing 304 at 21 feet from the weapon is only 1.4 feet and is half of the conventional dart spacing.

In operation, the improved dart bore angles 205 and 206 are selected to increase the effectiveness range of the weapon 100 by increasing the spacing between the first dart 122 and the second dart 124 at short distances by maintaining 8 degrees of total separation between the first and second dart trajectories 300, 302 while decreasing the spacing, at long distances from the weapon, between the first and second trajectories 300, 302 due to the parabolic shape of the first trajectory 300.

Figure 4:
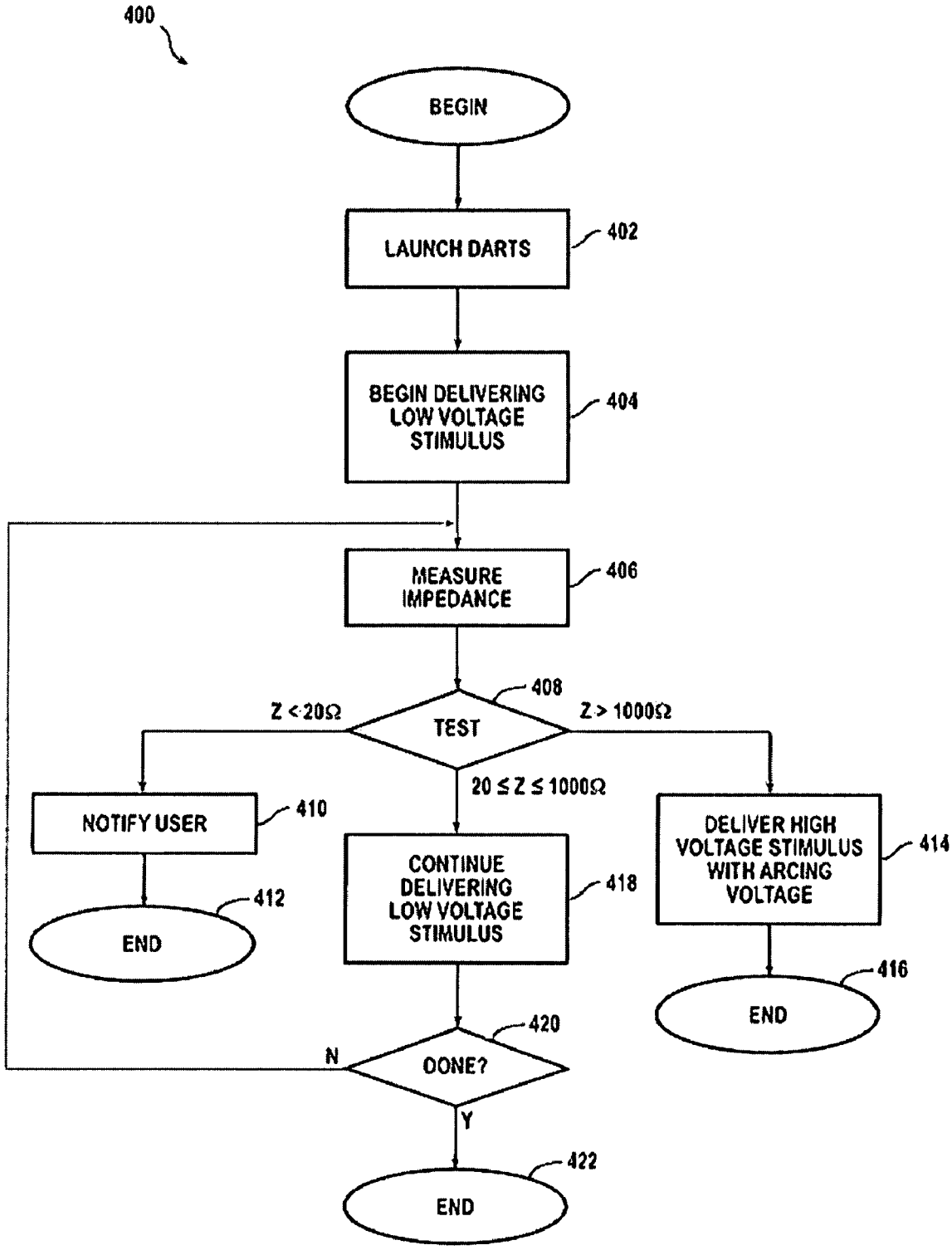
FIG. 4 is a process flow diagram for delivery of high voltage stimulus and low voltage stimulus, according to various aspects of the present invention.

Referring to FIG. 4, a flow diagram is shown depicting a method 400 for delivery of high voltage and low voltage waveforms. The method shown includes launching (402) a first dart 122 and a second dart 124, delivering (404) a low voltage waveform, and measuring (406) an impedance (Z). The method 400 may be performed by the electric weapon 100 of FIG. 1.

In operation, first dart 122 and second dart 124 are deployed (402) along the trajectories 300, 302 illustrated in FIG. 3 or a conventional trajectory. The first dart 122 and the second dart 124 strike (impact) the target creating a complete circuit (as described hereinabove) to which a low voltage waveform is initially applied (404) by the electrical pulse generator 110 by the generation of a pulse of low electrical potential. This pulse of low electrical potential causes a pulse of electric current to begin to flow through the first and second wires, through the first and second darts, and through the target. Next, an impedance (Z) is measured (406) via an output current delivered back to the electrical pulse generator 110 and microcontroller 102. If the measured impedance (Z) is less than 20 ohms (408), a short is suspected and the operator is notified (410, 105) to eject the cartridge and insert a new cartridge, i.e., to reload (412) the electric weapon (100). Once the darts 122, 124 have been deployed and the electric circuit 110 is no longer delivering electric pulses through the target, the operator disconnects the cartridge 120 from the barrel. The operator then manually loads into the barrel a new cartridge 120 containing new darts and coiled wires.

If measured impedance (Z) is greater than 1000 ohms (408) a lack of direct contact is suspected and high voltage circuitry 110 initiates and delivers (414) a pulse train of higher voltage pulses to the target to jump through clothing (416). If measured impedance (Z) is within the range of 20 to 1000 ohms, then the electric weapon 100 continues to deliver (418) the low voltage waveform and to measure impendence (406) during delivery (420, 422) of the lower voltage waveform.

Figure 5:
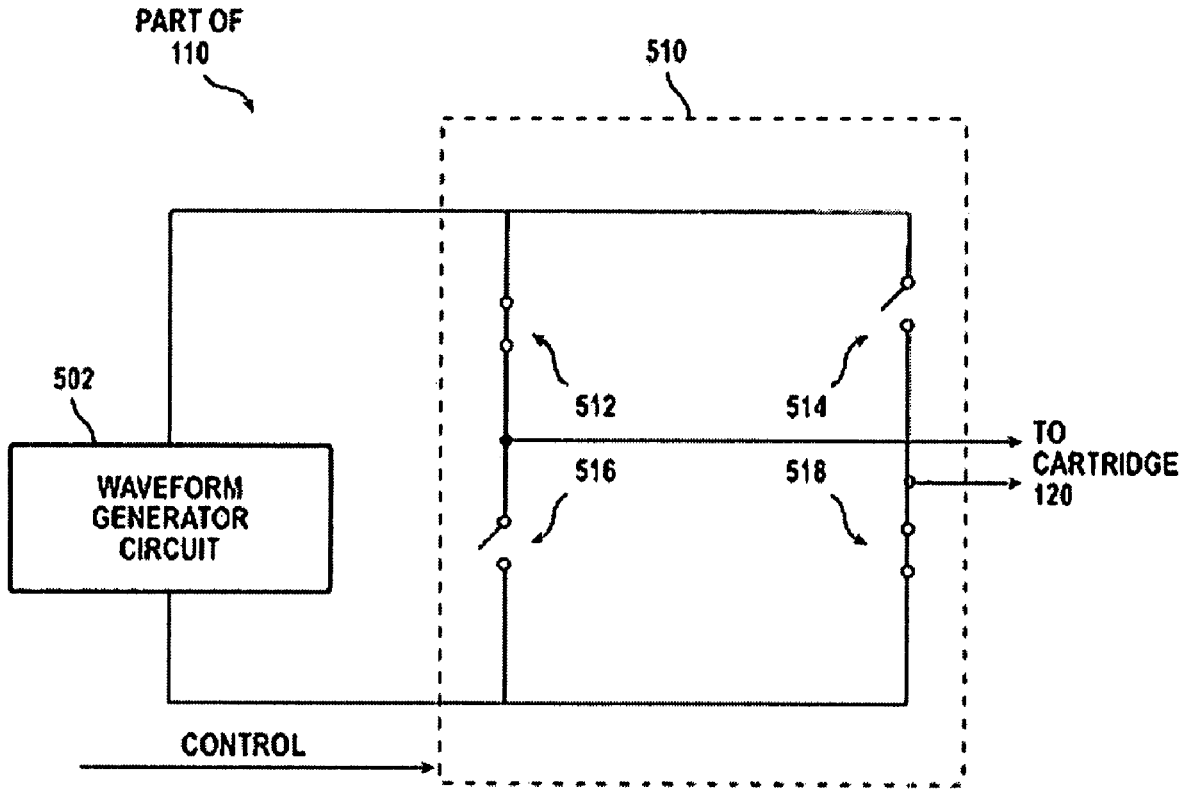
FIG. 5 is a schematic diagram of a biphasic waveform generator, according to various aspects of the present invention.

Referring next to FIG. 5, shown is a schematic diagram of a biphasic waveform generator, part of pulse generator 110. Circuit 502 generates a series of pulses. Switches 512, 518 are closed to provide a positive phase pulse. Switches 512 and 518 are opened and switches 514 and 516 are closed to provide a negative phase pulse. Switches 510 (including 512, 514, 516 and 518) may be controlled by microcontroller 102.

Figure 6:
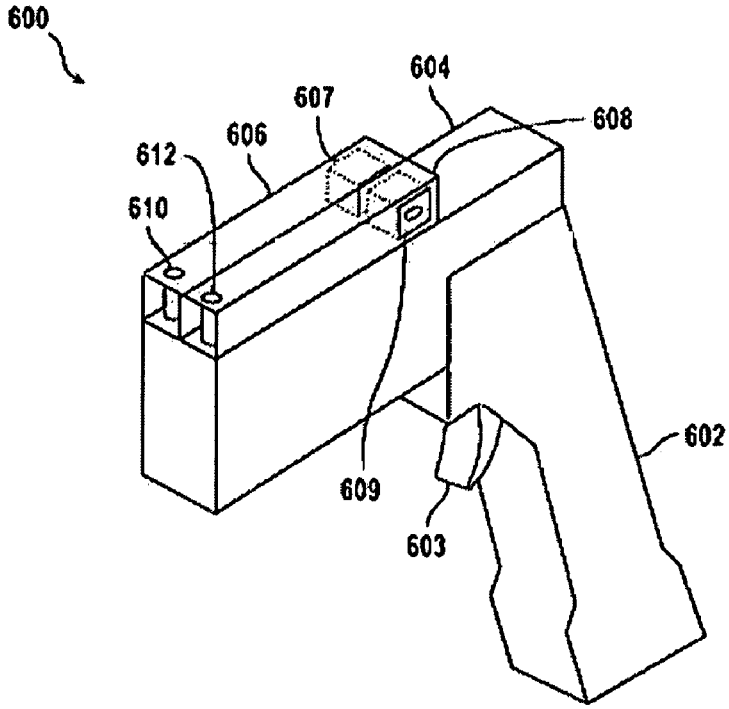
FIG. 6 is a perspective plan view of an improved immobilization device, according to various aspects of the present invention, having arms in a loaded position.
Figure 7:
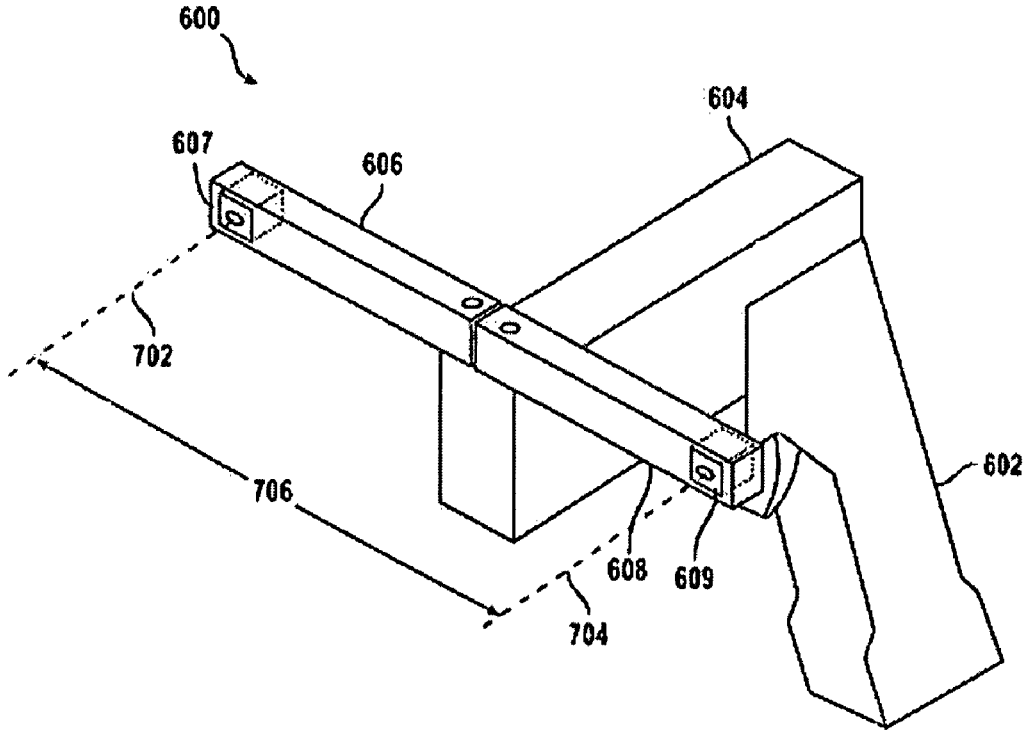
FIG. 7 is a perspective plan view of the device of FIG. 6 having arms in a firing position.

Referring next to FIGS. 6 and 7, shown in an improved immobilization weapon 600 with flip-out arms. Illustrated are a first arm 606, a second arm 608, a barrel 604, a mounting mechanism 610, 612, a first bore 607, and a second bore 609. The barrel 604 supports the first arm 606 and the second arm 608, each rotatably mounted 610, 612 on the barrel 604. The mounting mechanism 610, 612 secures the arms 606 and 608 to the barrel 604 and serves as a hinge. The first arm 606 contains the first bore 607. The first bore 607 houses the first dart. The second arm 608 contains the second bore 609. The second bore 609 contains the second dart.

In operation, the mounting mechanism 610, 612 allows for the rotation of the first and second arms within a horizontal plane, defined by the barrel, from a loaded position parallel to the barrel (FIG. 6) to a firing position (FIG. 7).

Referring next to FIG. 7, shown is an immobilization weapon 600 with flip-out arms in the firing position. Depicted are the first and second arms 606, 608, barrel 604, the first and second bore 607, 609, and the mounting mechanism 610, 612. Illustrated are the first arm 606 and the dart arm 608 rotated to the full extension. The first bore 607 housing the first dart and the second bore 609 housing the second dart are horizontally parallel to one another. The first dart and second dart are deployed from their respective bores in any conventional manner. The separation 706 between the axis 702 for bore 607 and the axis 704 of bore 609 is determined, in part, by the horizontal distance between the first bore 607 and the second bore 609, and a length of the arms. The minimum spread is achieved by selecting the length of the first arm 606, and the second arm 608.

In operation of an electric weapon according to FIGS. 1, 6, and 7, when the safety 103 is released, the arms 606 and 608 rotate to a position substantially normal to the barrel 604 of the weapon. The first and second arms 606 and 608 are then locked into place, the first bore 607 and the second bore 609 are aligned, i.e., their bore axes 702 and 704 are substantially parallel with one another, and the weapon is ready to deploy the darts. Upon firing (which is initiated, as described above, upon the actuation or pulling of the trigger 104, 603), the first dart is propelled from the first bore 607 by the means for firing, and the second dart is propelled from the second bore 609 by the means for firing. As the darts leave bores 607 and 609, the darts continuously travel in a horizontally parallel relationship as they approach the target. The spacing 706 between the darts is held consistent from deployment until contact with the target for any desired range.

Figure 8:
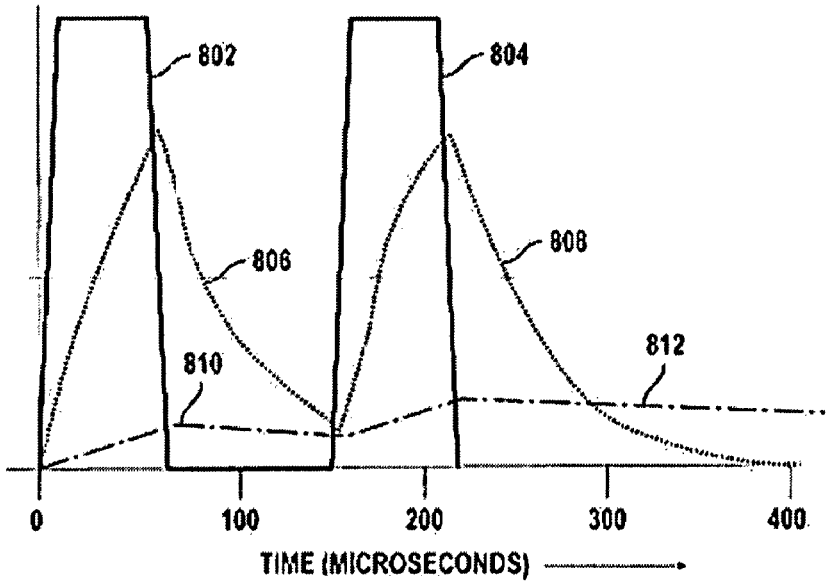
FIG. 8 is a graph of the response of a target to a split unipolar waveform.

Referring next to FIG. 8, shown is the response to a split unipolar waveform. The graph depicts a superposition of the applied voltage waveform 802, 804, motor neuron potential response 806, 808, and cardiac membrane potential response 810, 812. Each waveform is respectively scaled for clarity of presentation. The applied voltage waveform is split into a first rectangular pulse 802 and a second rectangular pulse 804, each with duration of 50 microseconds respectively.

Figure 9:
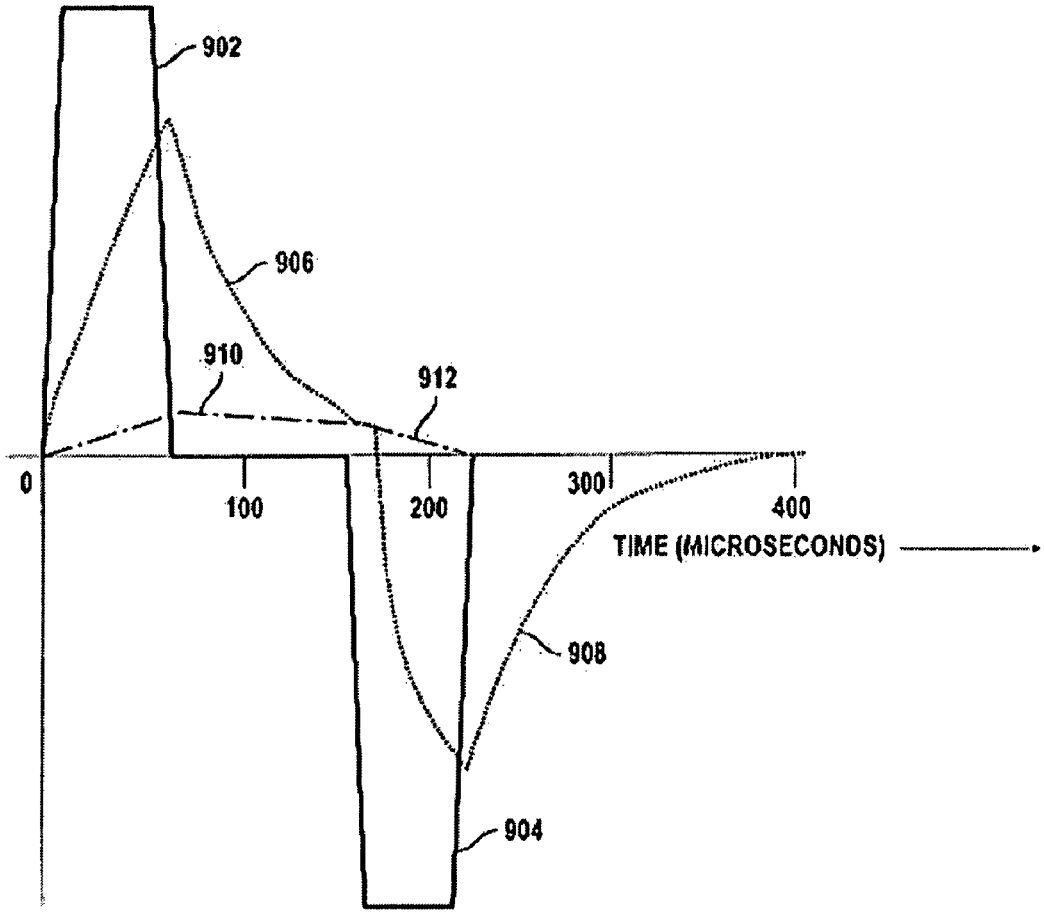
FIG. 9 is a graph of the response of a target to a biphasic waveform, according to various aspects of the present invention.

Referring next to FIG. 9, shown is the response to a biphase waveform according to various aspects of the present invention. The graph depicts a superposition of the applied voltage waveform 902, 904, motor neuron potential response 906, 908, and cardiac membrane potential response 910, 912. Each waveform is respectively scaled for clarity of presentation. The applied voltage waveform is split into a first rectangular pulse 902 and a second rectangular pulse 904 each with duration of 50 microseconds respectively. The first applied voltage pulse 902 and the second applied voltage pulse 904 are of opposite polarity. The spacing between the first pulse and the second pulse is 100 microseconds. As shown in FIG. 9, the motor neuron time constant is 100 microseconds and the cardiac membrane time constant is 3.5 milliseconds.

In operation, for the first pulse 902 the motor neuron potential response 906 and the cardiac membrane potential response 910 behave in a manner similar to that shown in FIG. 8. For the second pulse 904, the motor neuron potential response 908 is symmetrical to the motor neuron potential response 906, but the cardiac membrane potential response 912 exponentially approaches zero.

A method of immobilizing a target may include delivering a multiple polarity waveform of electrical current so that minimal net charge remains on cardiac cell membranes of the target.

An electric weapon that outputs a unipolar pulse of a given pulse duration may be improved by modifying the weapon to output two unipolar pulses of equal charge and opposite polarity. The shape of each pulse may be arbitrary. The pulses may have different shapes. The pulses may be separated by 50 microseconds to 1000 microseconds, preferably less than 500 microseconds. For pulses of 50 microseconds duration, a separation of 100 microseconds may be used.

The present invention, in some embodiments, provides an improvement on the performance and safety of an immobilization weapon. It will be further appreciated that by solving the problems created by electrically conductive dart spacing, multiple voltages, and cardiac membrane potential, the present embodiments are capable of reducing the potential cardiac risk to the target along with increasing the rate of success of direct contact.

While the invention herein disclosed has been described by means of specific embodiments and applications thereof, numerous modifications and variations could be made thereto by those skilled in the art without departing from the scope of the invention set forth in the claims.

What is claimed:

1. A method performed by an electric weapon, the method comprising: launching at least one electrically conductive dart; providing a series of pulses via the at least one dart for conduction through a target to cause contractions of the skeletal muscles of the target wherein: the series consists essentially of a plurality of pairs of pulses; each pair consists essentially of two pulses of different polarity, having substantially the same magnitude of charge, and separated from each other by from 50 to 1000 microseconds; and the pairs of the plurality are sequentially separated from each other by from 25 to 200 milliseconds.

2. The method of claim 1 wherein the pulses have substantially the same pulse width.

3. The method of claim 2 further comprising operating a switch to reverse the polarity of each second pulse of each pair.

4. The method of claim 1 further comprising operating a switch to reverse the polarity of each second pulse of each pair.

5. The method of claim 1 wherein each two pulses are separated by less than 500 microseconds.

6. The method of claim 1 wherein each two pulses are separated by about 100 microseconds.

* * * * *

UNITED STATES PATENT AND TRADEMARK OFFICE

CERTIFICATE OF CORRECTION

PATENT NO. : 7,520,081 B2
APPLICATION NO. : 11/182051
DATED : April 21, 2009
INVENTOR(S) : Mark W. Kroll It is certified that error appears in the above-identified patent and that said Letters Patent is hereby corrected as shown below:

Title Pg, Item (75), in "Inventor", in column 1, line 1, delete "Mark Kroll," and insert -- Mark W. Kroll, --, therefor.

Title Pg, Item (57), under "ABSTRACT", in column 2, line 12, after "delivery; and", delete "delivery" and insert -- delivering --, therefor.

In column 1, line 19, delete "or" and insert -- of --, therefor.

In column 1, line 59, after "from the first", delete "data" and insert -- dart --, therefor.

In column 2, line 38, after "for rates", delete "5," and insert -- of 5, --, therefor.

In column 3, line 59, after "The", delete "pulse" and insert -- pulses --, therefor.

In column 4, line 24, after "models", delete "with" and insert -- using --, therefor.

In column 6, line 52, after "606 and the", delete "dart" and insert -- second --, therefor.

Signed and Sealed this
Twenty-seventh Day of September, 2011

David J. Kappos

David J. Kappos
*Director of the United States Patent and Trademark Office*